US010563898B2

(12) United States Patent
Park

(10) Patent No.: US 10,563,898 B2
(45) Date of Patent: Feb. 18, 2020

(54) ARTIFICIAL INTELLIGENCE REFRIGERATOR HAVING ICE-MAKING FUNCTION

(71) Applicant: LG Electronics Inc., Seoul (KR)

(72) Inventor: Shinhyun Park, Seoul (KR)

(73) Assignee: LG Electronics Inc., Seoul (KR)

( * ) Notice: Subject to any disclaimer, the term of this patent is extended or adjusted under 35 U.S.C. 154(b) by 85 days.

(21) Appl. No.: 15/955,101

(22) Filed: Apr. 17, 2018

(65) Prior Publication Data

US 2018/0313594 A1 Nov. 1, 2018

(30) Foreign Application Priority Data

Apr. 28, 2017 (KR) ..... 10-2017-0055568

(51) Int. Cl.
*F25C 5/20* (2018.01)

(52) U.S. Cl.
CPC ..... *F25C 5/22* (2018.01); *F25C 2600/02* (2013.01); *F25C 2600/04* (2013.01)

(58) Field of Classification Search
CPC .... F25C 5/22; F25C 5/02; F25C 5/187; F25C 5/08; F25C 5/16; F25C 1/00; F25C 1/24; F25C 1/04; F25C 1/12; F25C 1/147; F25C 2600/04; F25C 2600/02; F25D 2400/30
See application file for complete search history.

(56) References Cited

FOREIGN PATENT DOCUMENTS

| | | | |
|---|---|---|---|
| JP | 2004053092 | | 2/2004 |
| JP | 2013007510 | | 1/2013 |
| JP | 2013007510 A | * | 1/2013 |
| KR | 1020080048340 | | 6/2008 |
| KR | 1020130021146 | | 3/2013 |
| KR | 1020140050215 | | 4/2014 |

* cited by examiner

*Primary Examiner* — Emmanuel E Duke
(74) *Attorney, Agent, or Firm* — Fish & Richardson P.C.

(57) ABSTRACT

An artificial intelligence (AI) refrigerator includes an evaporator, a freezing chamber, an ice-making unit, a cold air duct that connects the freezing chamber to the ice-making unit, a discharge unit that discharges ice, and a controller. The controller is configured to generate ice extraction information that includes an extraction time at which a user has extracted ice, and an amount of ice extracted at the extraction time, determine an ice extraction pattern based on ice extractions captured in the ice extraction information, based on the ice extraction pattern, generate an ice-making pattern that includes one or more ice-making start times and an ice-making amount corresponding to each ice-making start time, and based on the ice-making amount, adjust an amount of cold air introduced from the freezing chamber to the ice-making unit through the cold air duct to accelerate or decelerate an ice-making speed corresponding to each ice-making start time.

20 Claims, 8 Drawing Sheets

ARTIFICIAL INTELLIGENCE REFRIGERATOR HAVING ICE-MAKING FUNCTION

CROSS-REFERENCE TO RELATED APPLICATION

Pursuant to 35 USC § 119 (a), this application claims the benefit of an earlier filing date and priority to Korean Application No. 10-2017-0055568, filed on Apr. 28, 2017, the contents of which are incorporated by reference herein in its entirety.

FIELD

The present disclosure relates to a refrigerator having an ice-making function.

BACKGROUND

A refrigerator is an apparatus that can discharge cold air generated by a refrigeration cycle, which includes a compressor, a condenser, an expansion valve, an evaporator, and the like, to lower internal temperature so as to keep foods and the like in a frozen state or a fresh state.

Recently, functions of the refrigerator have been diversified from its original function of keeping foods in the frozen or fresh state. For example, recently introduced refrigerators may include a water purification function, and the water purification function may further include an ice-making function for generating ice using purified water. In addition, purified water or ice may be provided through a dispenser installed at a door of the refrigerator.

On the other hand, for the refrigerator having the water purification function, when an ice extraction is selected by a user, ice may be generated by cooling purified water through an ice-making function. Then, the generated ice is discharged through the dispenser. In this case, the refrigerator may accelerate an ice-making speed when the user needs more ice.

On the other hand, the user may require a larger amount of ice than the ice produced through the ice-making function. For example, in a family with a large number of members, if each member requires for ice, an amount of ice required may be greater than an amount of ice produced through one-time ice-making function. Therefore, in such a case, the user has to accelerate the ice-making speed every time of taking out ice such that more ice can be produced.

On the other hand, when the ice-making speed is accelerated in this manner, a cooling temperature which is lower than a cooling temperature required for producing ice is generally required. As a result, more power may be consumed for accelerating an operating speed of a cooling fan, and the like. Further, even if the ice-making speed is accelerated more, a predetermined time is required for making ice. This causes a waiting time until producing additional ice.

SUMMARY

The present invention is directed to solving the above problems and other drawbacks, and one aspect of the present invention is to provide a refrigerator and a refrigerator system, capable of sufficiently discharging ice as much as required by a user when the user selects an ice discharge (or ice extraction, ice take-out, etc.).

Another aspect of the present invention is to provide a refrigerator and a refrigerator system, capable of saving energy required for accelerating an ice-making speed.

According to one aspect of the present invention to achieve the aforementioned purposes or other objective, there is provided a refrigerator including a freezing chamber provided with a freezing chamber evaporator for generating cold air, an ice-making unit to generate ice using the cold air generated in the freezing chamber, a cold air duct connecting the freezing chamber to the ice-making unit such that the cold air introduced from the freezing chamber is discharged to the ice-making unit, a discharge unit to discharge the ice generated from the ice-making unit, and a controller to generate ice extraction information including a time at which a user has extracted the ice and an amount of the extracted ice, analyze an ice extraction pattern of the user based on a plurality of ice extraction information, generate an ice-making pattern including at least one ice-making start time at which the ice-making is started and an ice-making amount corresponding to each ice-making start time on the basis of the analyzed ice extraction pattern, and accelerate or decelerate an ice-making speed at each ice-making start time by adjusting an amount of the cold air introduced into the ice-making unit from the freezing chamber through the cold air duct according to the ice-making amount corresponding to each ice-making start time.

In one embodiment, the cold air duct may include a duct valve to adjust an opening area of the cold air duct, and the controller may control the duct valve so that different amounts of cold air are introduced from the freezing chamber to the ice-making unit depending on the ice-making amount corresponding to each of the at least one ice-making start time.

In one embodiment, the cold air duct may include a cooling fan to force the cold air generated in the freezing chamber to be introduced into the cold air duct, and the controller may control a rotation speed of the cooling fan such that different amounts of cold air are introduced from the freezing chamber to the ice-making unit depending on the ice-making amount corresponding to each of the at least one ice-making start time.

In one embodiment, the ice-making unit may further include a water supply valve to supply water for generating the ice, and the controller may control the water supply valve so that different amounts of water are supplied to the ice-making unit depending on the ice-making amount corresponding to each of the at least one ice-making start time.

In one embodiment, the controller may detect whether or not the user has taken out the ice according to whether or not an extraction opening as an outlet through which the ice is discharged from the discharge unit is opened. Also, the controller may store information related to an open time of the extraction opening as information related to a time at which the user has extracted the ice, and calculate an amount of the ice extracted by the user according to a time duration during which the extraction opening remains open.

In one embodiment, the controller may decide at least one ice extraction time at which the user extracts the ice based on the analysis result of the ice extraction pattern, and decide an ice extraction amount corresponding to each of the decided at least one ice extraction time. The at least one ice-making start time may be a time decided as a time earlier than the decided at least one ice extraction time by a preset time duration. The ice-making amount corresponding to each of the at least one ice-making start time may be decided according to an ice extraction amount corresponding to each of the decided at least one ice extraction time.

In one embodiment, the controller may divide whole hours a day into a plurality of time intervals according to a preset time unit, detect at least one time interval, in which the ice extraction has been detected a preset number of times or more, based on each time interval and the plurality of ice extraction information, and decide at least one ice extraction time corresponding to the detected at least one time interval, respectively, based on the detected time interval. Also, the controller may sum up an amount of ice extracted by the user for each of the detected at least one time interval, calculate an average of the summed amount of ice for each time interval, and decide an ice extraction amount corresponding to each of the at least one user ice extraction time.

In one embodiment, the controller may decide ice extraction time durations corresponding to the plurality of ice extraction information, respectively, detect at least one common time interval commonly included in the decided ice extraction time durations, decide at least one ice extraction time based on the common time interval, sum up an amount of ice extracted for each ice extraction time duration, calculate an average of the extracted ice amount for each ice extraction time duration including the common time interval, and decide at least one of the calculated average ice amounts as an ice extraction amount corresponding to the at least one ice extraction time.

In one embodiment, the refrigerator may further include a communication unit to perform wireless communication with a preset server, and the controller may perform a time synchronization with the server based on time information received from the server.

In one embodiment, the controller may control the communication unit to transmit the plurality of ice extraction information to the server, receive an analysis result of the user's ice extraction pattern from the server in response to the plurality of ice extraction information transmitted to the server, and generate, based on the received ice extraction pattern, the ice-making pattern including the at least one ice-making start time at which the ice-making is started, and the ice-making amount corresponding to each ice-making start time.

In one embodiment, the controller may control the communication unit to transmit the ice extraction information to the server. When an ice-making control signal including information related to a specific ice-making amount is received from the server, the controller may accelerate or decelerate an ice-making speed by adjusting an amount of cold air, introduced into the ice-making unit from the freezing chamber through the cold air duct, according to the specific ice-making amount. The ice-making control signal may be received from the server when a current time corresponds to one ice-making start time, which is included in an ice-making pattern generated by the server, based on the user's ice extraction pattern analyzed from the plurality of ice extraction information.

DETAILED DESCRIPTION

Figure 1:
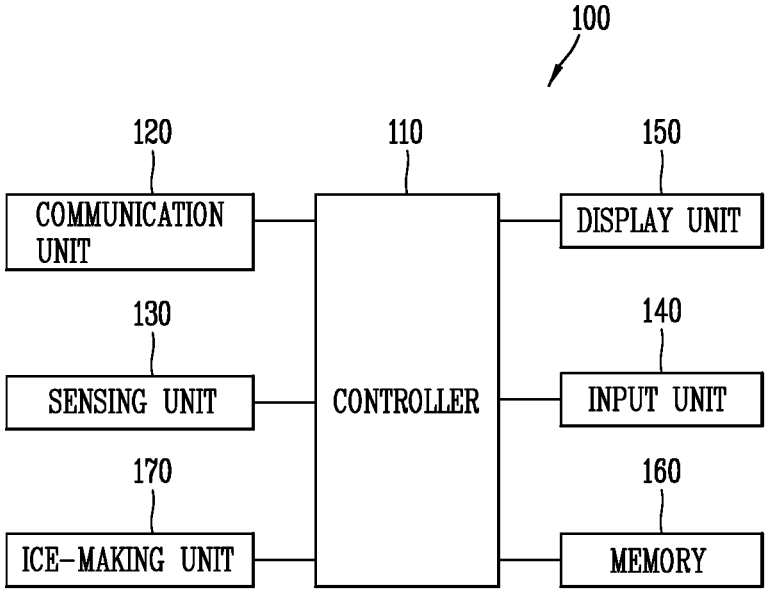
FIG. 1 RELATED ART
FIG. 1 is a block diagram of a refrigerator in accordance with the present invention.

Hereinafter, embodiments of the present invention will be described in detail with reference to the accompanying drawings, and the same/like reference numerals are used to designate the same/like components and redundant description thereof will be omitted. In general, a suffix such as "module" and "unit" may be used to refer to elements or components. Use of such a suffix herein is merely intended to facilitate description of the specification, and the suffix itself is not intended to give any special meaning or function. In describing the present invention, if a detailed explanation for a related known technology or construction is considered to unnecessarily divert the gist of the present disclosure, such explanation has been omitted but would be understood by those skilled in the art. The accompanying drawings are used to help easily understand the technical idea of the present invention and it should be understood that the idea of the present invention is not limited by the accompanying drawings. The idea of the present invention should be construed to extend to any alterations, equivalents and substitutes besides the accompanying drawings.

FIG. 1 is a block diagram illustrating a refrigerator 40 according to an embodiment of the present invention.

The refrigerator 40 may include a communication unit 120, a sensing unit 130, an input unit 140, a display unit 150, a memory 160, and an ice-making unit 170. Those components illustrated in FIG. 1 are not essential for implementing the refrigerator 40, and the refrigerator 40 described in this specification may be provided with more or less components than the components listed above.

Among others, the communication unit 120 may include one or more modules enabling wireless communications between the refrigerator 40 and a preset communication system, between the refrigerator 40 and at least one external device, or between the refrigerator 40 and a specific external server. In addition, the communication unit 120 may include one or more modules that connect the refrigerator 40 to one or more networks. More specifically, the communication unit 120 may perform wireless communication with a preset server, and allow various types of data to be exchanged between the server and the refrigerator which are connected to each other through the wireless communication.

Meanwhile, the sensing unit 130 may include at least one sensor for sensing at least one of internal information related to the refrigerator 40, surrounding environment information of the refrigerator 40, and user information. For example, the sensing unit 140 may include a scan unit (not illustrated) for scanning an identification code such as a bar code or a QR code. The scan unit may include at least one other sensor such as an image sensor, an infrared sensor or a laser sensor, and may recognize an identification code included in an image that the sensors sense. The scan unit may also input information related to the recognized identification code to a controller 110 in a form of text or image. Then, the controller 110 may store the information related to the recognized identification code in the memory 160 or display the information related to the recognized identification code on the display unit 150.

Meanwhile, the sensing unit 130 may include at least one sensor for measuring an amount of ice stored in the ice-making unit 170 of the refrigerator 40. For example, the at least one sensor may be a weight sensor for measuring a weight of ice stored in the ice-making unit 170 or may be a volumetric sensor for measuring a volume of ice stored in the ice-making unit 170. Alternatively, the at least one sensor may be a sensor for checking the number of ice pieces separated from the ice-making unit 170.

Also, the sensing unit 140 may include at least one of a pressure sensor which can measure pressure applied by a touch input when the touch input applied by the user is sensed through a touch sensor, an infrared (IR) sensor, a finger scan sensor, an ultrasonic sensor, a microphone, an environmental sensor (for example, a hygrometer, a thermometer, an odor sensor, etc.), and a biometric sensor such as an iris scan sensor or the like. Meanwhile, the refrigerator 40 disclosed herein may combine and use information sensed by at least two of those sensors.

On the other hand, the display unit 150 displays (outputs) information processed in the refrigerator 40. For example, the display unit 150 may display execution screen information of an application program run in the refrigerator 40, or UI (User Interface) and GUI (Graphic User Interface) information according to the execution screen information.

The display unit 150 may be interlayered or integrally formed with the touch sensor so as to realize a touch screen. The touch screen may function as a user input unit providing an input interface between the refrigerator 40 and the user and simultaneously provide an output interface between the refrigerator 40 and the user.

The input unit 140 may include a microphone or an audio input unit for enabling an input of an audio signal, and at least one key for allowing the user to input information. The at least one key may include a virtual key, a soft key, or a visual key displayed on the touch screen through software processing or a touch key (touch key) disposed on a portion other than the touch screen. On the other hand, the virtual key or the visual key may be displayed on the touch screen in various forms, for example, a graphic, a text, an icon, a video, or a combination thereof.

In addition, the memory 160 stores data supporting various functions of the refrigerator 40. The memory 160 may store a plurality of application programs (or applications) run in the refrigerator 40, data for operations of the refrigerator 40, and commands. At least some of these applications may be downloaded from an external server through wireless communication. Also, at least some of these application programs may be installed in the refrigerator 40 from the time of shipment for basic functions of the refrigerator 40 (e.g., a temperature management function for each storage area).

On the other hand, the ice-making unit 170 may produce ice under the control of the controller 110. The ice-making unit 170 may perform an ice-making process using water supplied from a water supply valve and cold air introduced from a freezing chamber of the refrigerator 40.

Meanwhile, the ice produced through the ice-making process may be stored in an ice bank, and the stored ice may be extracted (discharged, taken out, etc.) through an extraction opening (an ice duct) formed at a lower portion of the ice-making unit 170. The extraction opening may be opened when pressure is applied to a lever provided on the dispenser. When the extraction opening is opened, the ice stored in the ice bank may be discharged through the extraction opening.

On the other hand, the controller 110 controls an overall operation of the refrigerator 40. The controller 110 may process signals, data, information, and the like input or output through the aforementioned components or run an application program stored in the memory 160, so as to perform the basic functions of the refrigerator 40, namely, functions of keeping foods in a frozen or fresh state by lowering internal temperature of the refrigerator using discharged cold air and provide to the user or process appropriate information related to the functions of the refrigerator 40.

Also, the controller 110 may control at least some of the components illustrated in FIG. 1A, to execute an application program stored in the memory 160. Further, the controller 110 may operate at least two or more components included in the refrigerator 40 in combination with each other to execute the application program.

Meanwhile, the controller 110 may exchange various data with a preset server through the communication unit 120. For example, the controller 110 may receive information related to an absolute time from the preset server and may synchronize the received absolute time information with time information of the refrigerator 40. In this case, the time of the preset server and the time of the refrigerator 40 may be synchronized with each other.

Also, when ice is discharged through the dispenser, the controller 110 may detect that the ice generated by the ice-making unit 170 has been taken out by the user. Here, the controller 110 may detect an amount of ice extracted (i.e., an ice extraction amount) and an ice extraction time according to opening of the extraction opening of the dispenser. For example, when the user opens the extraction opening by applying pressure to the lever connected to the extraction opening, the controller 110 may determine that the user has extracted (taken out) the ice and detect a time at which the extraction opening has been opened as a time at which the user has taken out the ice. Also, the controller 110 may measure an amount of ice which has been extracted for a duration during which the extraction opening is opened, based on a duration during which the extraction opening is opened and an ice extraction amount per unit time. That is, the controller 110 may store an opened (time) duration and an opened time of the extraction opening and store an extracted time of ice and an extracted amount of ice.

On the other hand, the obtained extracted time information and the extracted amount of ice may be used to analyze the user's ice extraction pattern. The analyzed ice extraction pattern may be used by the controller 110 of the refrigerator 40 according to the embodiment disclosed herein or a server connectable with the refrigerator 40 in order to generate an ice-making pattern. Meanwhile, the controller 110 may control the ice-making unit 170 to perform ice-making based on the ice-making pattern.

Figure 2A:
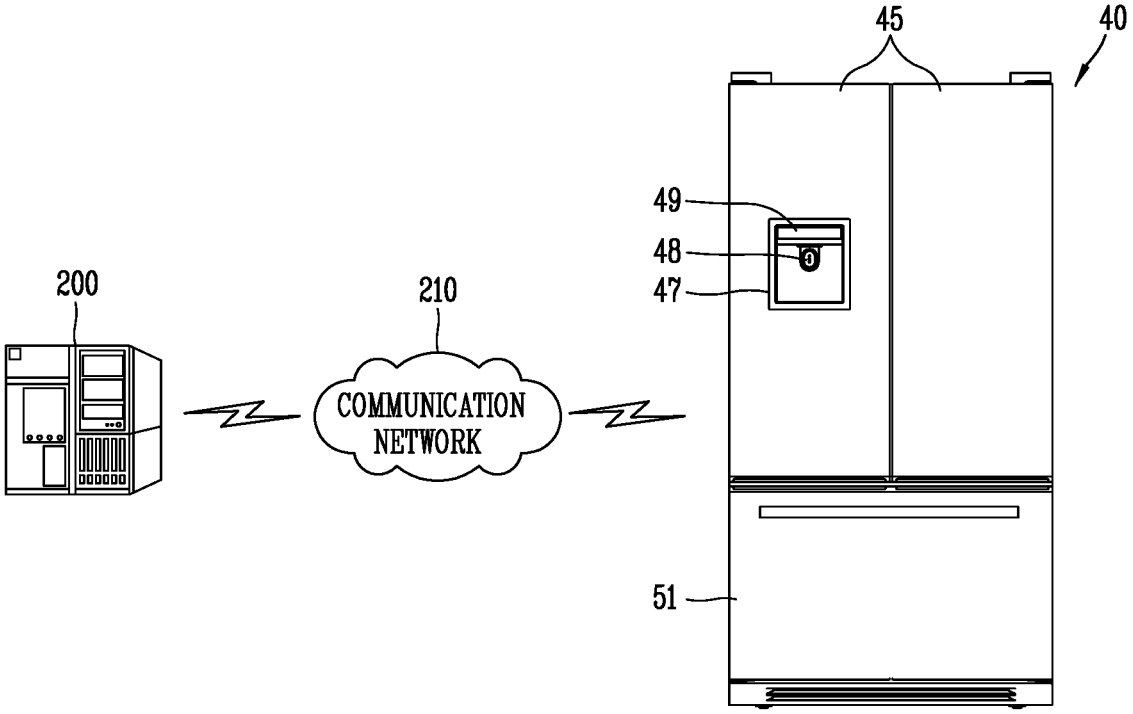
FIG. 2A RELATED ART
FIG. 2A is a conceptual view illustrating an example in which the refrigerator according to the present invention is connected to a preset server through a communication network.

FIG. 2A is a conceptual view illustrating an example in which the refrigerator 40 related to the present invention and a preset server are connected to each other through a communication network.

Figure 2B:
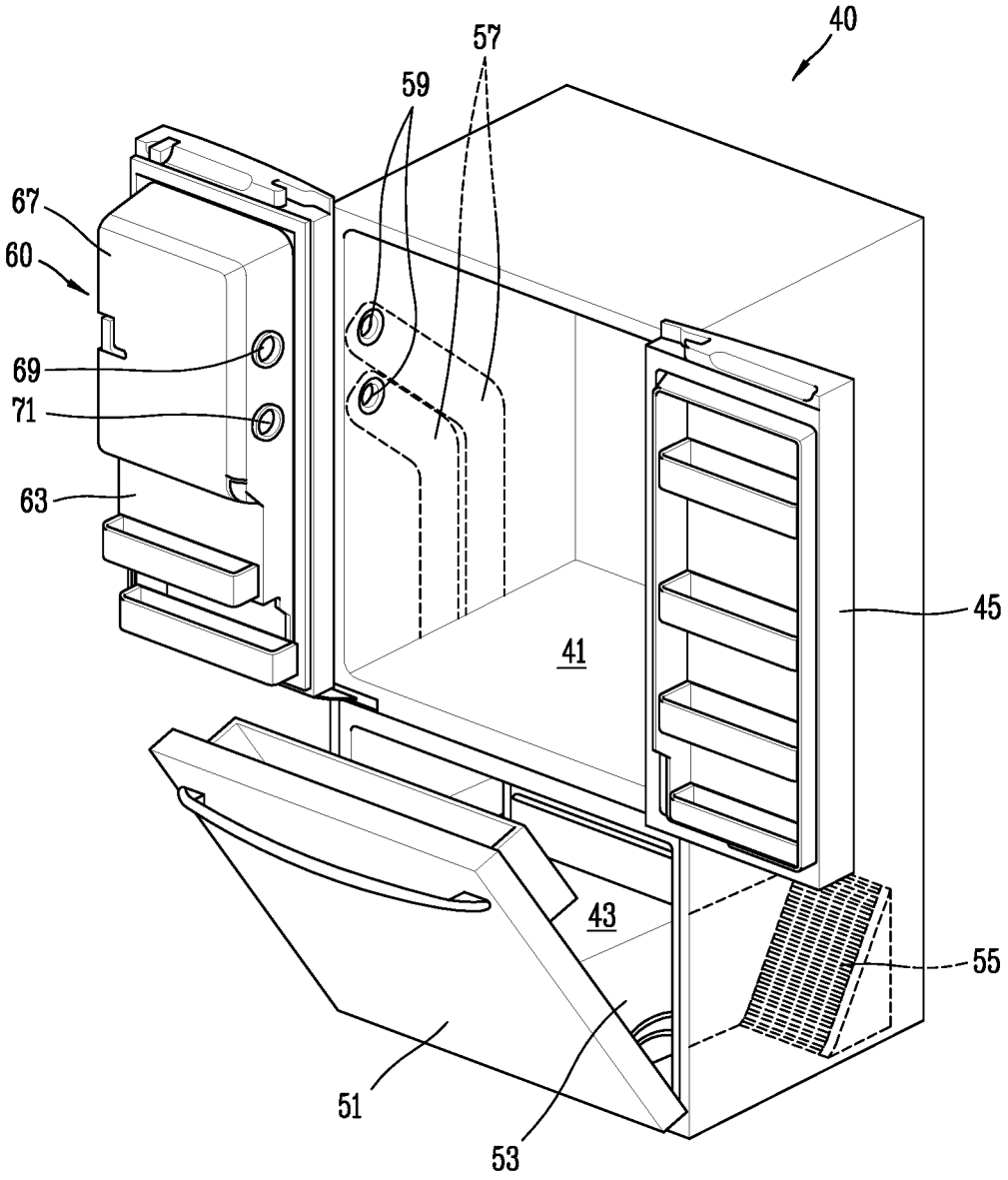
FIG. 2B RELATED ART
FIG. 2B is a view illustrating in more detail a structure of a refrigerator having an ice-making function according to the present invention.
Figure 2C:
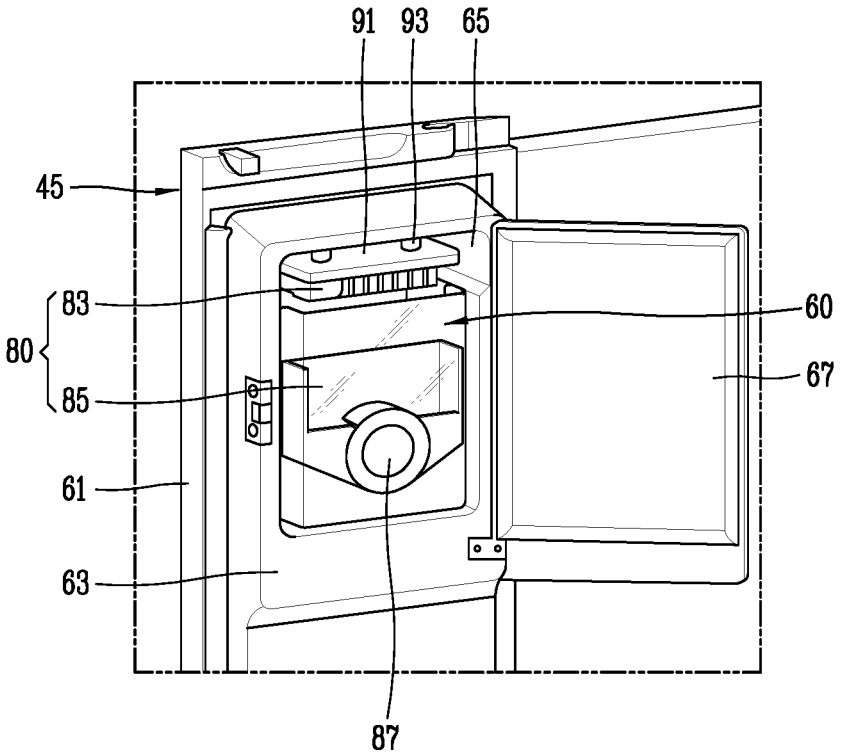
FIG. 2C RELATED ART
FIG. 2C is a view illustrating in more detail a structure of an ice-making unit in the refrigerator according to the present invention.

FIG. 2B is a view illustrating in more detail a structure of the refrigerator 40 having an ice-making function according to the present invention, and FIG. 2C is a view illustrating in more detail a structure of the ice-making unit in the refrigerator 40 related to the present invention.

Figure 2D:
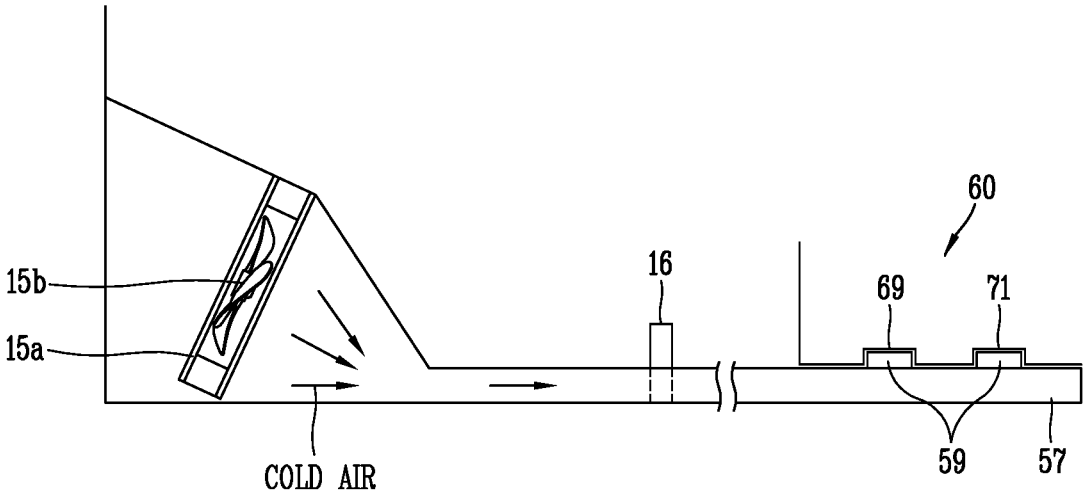
FIG. 2D RELATED ART
FIG. 2D is a view illustrating in more detail a structure in which cold air is supplied to a cold air duct by a cold air supply fan in the refrigerator according to the present invention.

Also, FIG. 2D is a view illustrating in more detail a structure in which cold air is supplied to a cold air duct by a cold air supply fan in the refrigerator 40 according to the present invention.

First, referring to FIGS. 2A to 2D, at least one door of the refrigerator 40 according to the embodiment of the present invention may include an ice-making unit 170, and a dispenser 47 connected to the ice-making unit 170.

As illustrated, the refrigerator body 40 (or the refrigerator) is divided into upper and lower parts. A refrigerating chamber 41 is provided at the upper part of the refrigerator body 40 and a freezing chamber 43 is provided at the lower part. Various types of baskets, shelves and drawers for efficiently storing various kinds of foods are provided in the refrigerating chamber 41 and the freezing chamber 43.

A front surface of the refrigerating chamber 41 is opened and the opened front surface of the refrigerating chamber 41 is selectively closed by refrigerating chamber doors 45. The refrigerating chamber doors 45 are coupled to left and right sides of the refrigerator body 40, respectively, by hinges.

The refrigerating chamber door 45 provided at one side of the refrigerating chamber doors 45 is provided with the dispenser 47, which allows purified water and ice to be taken out from outside, and may further be provided with an operation unit 49 having a display and operation buttons such that an internal temperature is adjusted and an internal state is output.

Referring to FIG. 2B, the freezing chamber 43 which is separately partitioned from the refrigerating chamber 41 is provided below the refrigerating chamber 41. A front surface of the freezing chamber 43 is also opened and the opened front surface of the freezing chamber 43 is selectively closed by a freezing chamber door 51.

A lower end of the freezing chamber door 51 is coupled by hinges to a lower end of a storage box 53 in which foods are stored. Accordingly, when the freezing chamber door 51 is opened, the storage box 53 is cooperatively drawn out from the opened front surface of the freezing chamber 43 in a sliding manner.

A freezing chamber evaporator 55 may be provided in a direction opposite to an open direction of the freezing chamber 43. The freezing chamber evaporator 55 may serve to generate cold air through heat exchange with external air. The cold air generated by the freezing chamber evaporator 55 may lower an internal temperature of the freezing chamber 43.

Some of the cold air generated by the freezing chamber evaporator 55 may be introduced into an ice-making chamber 60, which will be described below, through a cold air duct 57. A cold air supply fan 15*a* is provided at one side of the freezing chamber 43. Accordingly, the cold air generated by the freezing chamber evaporator 55 may be forcibly introduced into the ice-making chamber 60 by the cold air supply fan 15*a* through the cold air duct 57.

The cold air duct 57 is provided in one side surface of the refrigerating chamber 41, and an inside of the refrigerating chamber 41 is filled with an insulating material, to prevent a change of a temperature of cold air flowing through the cold air duct 57. Two cold air ducts 57 are provided, and each of the cold air ducts 57 may serve as a flow path of the cold air.

A cold air transfer hole 59 may be formed at one end of each cold air duct 57, which comes in contact with one side surface of the refrigerating chamber 41. The cold air flowing through the cold air duct 57 may flow into and out of the ice-making chamber 60 through the cold air transfer hole 59.

Referring to FIG. 2C, the ice-making chamber 60 may be provided on an inside of the refrigerating chamber door 45 having the dispenser 47 of the refrigerating chamber doors 45. The ice-making chamber 60 may be provided on the inside of the refrigerating chamber door 45 to facilitate ice to be taken out in the refrigerator having the freezing chamber 43 which is located relatively downward.

An outer surface of the refrigerating chamber door 45 may be configured as a door plate 61 which is made of stainless steel or an aluminum alloy. A rear surface of the refrigerating chamber door 45 may be configured as a door liner made of a synthetic resin material and a part of the door liner may be configured as a casing 63 in which an ice-making assembly 80 to be described below is to be mounted.

The casing 63 may be constituted by the part of the door liner, and a part of the casing 63 may be recessed to form an inner space 65. The ice-making assembly 80 may be mounted in the inner space 65. An extraction opening may be formed through a bottom surface of the inner space 65 to communicate inside and outside of the inner space 65 with each other. The extraction opening 65' may be a flow path through which ice, which is produced by the ice-making assembly 80 to be described below, is discharged to the outside.

One surface of the casing 63 is opened and the opened one surface of the casing 63 may selectively be closed by the ice-making chamber door 67. A suction hole 69 and a discharge hole 71 may be formed through one side surface of the inner space 65 which comes in contact with the side surface of the refrigerating chamber 41, such that the inside and outside of the inner space 65. The suction hole 69 and the discharge hole 71 may be formed to communicate with the cold air transfer holes 59 connected to the freezing chamber evaporator 55 when the refrigerating chamber door 45 is closed.

Therefore, the cold air generated by the freezing chamber evaporator 55 can be introduced into the inner space 65 through the suction hole 69, and cold air circulated through the inner space 65 can be discharged to the freezing chamber evaporator 55 through the discharge hole 71.

Meanwhile, the cold air duct 57 may include a duct valve and may be opened and closed selectively by the duct valve. For example, when the ice-making chamber door 67 is opened, the controller 110 may control the duct valve to close the cold air duct 57, thereby preventing cold air from flowing out of the cold air duct 57. In addition, the controller 110 may control the duct valve to open only a part of the cold air duct 57, thereby controlling an amount of cold air introduced into the ice-making chamber 60 through the cold air duct 57.

Meanwhile, the ice-making assembly 80 may be mounted in the inner space 65. The ice-making assembly 80 may be provided to produce ice using cold air introduced from the freezing chamber evaporator 55. The ice-making assembly 80 may include a support plate (not illustrated). The support plate is for supporting the ice-making assembly 80 and may be erected on one surface of the inner space 65, which is located in a front direction of the refrigerating chamber door 45.

A coupling portion (not illustrated) may be provided on one end of the support plate in a manner of being bent in an open direction of the inner space 65. The coupling portion may be fixed to a bottom surface of the inner space 65 by a coupling member such as a screw. The support plate may be fixed to the inner space 65 by the coupling portion, and a through hole may be formed on one surface of the coupling portion to correspond to a position of the extraction opening.

An ice maker 83 is mounted on an upper portion of the support plate and perform ice-making using water supplied through a water supply valve. Here, the controller 110 may control the water supply valve to control an amount of water introduced into the ice maker 83.

On the other hand, an ice bank 85 may be mounted on a lower portion of the support plate. The ice bank 85 may temporarily store ice made by the ice maker 83 to be extracted to the outside. The ice maker 83 and the ice bank 85 may be mounted on the support plate so as to be configured as a single module.

The ice bank 85 may include a storage case 87 for storing ice made by the ice maker 83, and an ice separator which allows the ice stored in the storage case 87 to be discharged through the extraction opening. The storage case 87 may be provided below the ice maker 83 to store the ice made by the ice maker 83, and have a width corresponding to a width of the inner space 65 so as to be settled in the inner space 65.

On the other hand, FIG. 2D is a view illustrating in more detail the structure of the cold air duct having the cooling fan in the refrigerator 40 having the ice-making function according to the embodiment of the present invention.

Referring to FIG. 2D, the cold air duct 57 may include a cooling fan 15*a* and a fan motor 15*b* for sucking cold air from the freezing chamber and forcibly blowing the sucked cold air. Accordingly, cold air generated by the freezing chamber evaporator 55 can be forcibly introduced into the ice-making chamber 60 by the cooling fan 15*a*. Meanwhile, the cold air duct 57 may further include a duct valve 16. The duct valve 16 may adjust an opening area of the cold air duct 57 under the control of the controller 110, to control cold air introduced into the ice-making chamber 60 through the cold air duct 57. On the other hand, FIG. 2D illustrates the example of controlling the amount of introduced cold air using both of the cooling fan 15*a* and the duct valve 16, but the present invention may also be applied to an example of controlling the amount of introduced cold air using one of them. In this case, it is needless to say that only one of the cooling fan 15*a* and the duct valve 16 may be provided in the cold air duct 57.

Meanwhile, the refrigerator 40 may be connected to a preset server 200 through the communication network 210. For example, the communication network 210 may be a communication network constructed according to Global System for Mobile communication (GSM), Code Division Multi Access (CDMA), Code Division Multi Access 2000 (CDMA2000), Enhanced Voice-Data Optimized or Enhanced Voice-Data Only (EV-DO), Wideband CDMA (WCDMA), High Speed Downlink Packet Access (HSDPA), High Speed Uplink Packet Access (HSUPA), Long Term Evolution (LTE), LTE-Advanced (LTE-A), and the like.

Alternatively, the communication network 210 may be a short-range communication network constructed according to Wireless LAN (WLAN), Wireless Fidelity (Wi-Fi), Wi-Fi Direct, Digital Living Network Alliance (DLNA), Wireless Broadband (WiBro), World Interoperability for Microwave Access (WiMAX), High Speed Downlink Packet Access (HSDPA), High Speed Uplink Packet Access (HSUPA), Long Term Evolution (LTE), Long Term Evolution-Advanced (LTE-A), and the like.

On the other hand, the server 200 may transmit information related to absolute time to the refrigerator 40 through the communication network 210, as described above. Here, the absolute time information may be time information that the server 200 receives from a reference time source, such as a GPS satellite, which provides reference time information. The server 200 may transmit the absolute time information to the refrigerator 40 according to a preset period or according to a time information request received from the refrigerator 40.

On the other hand, the server 200 may receive from the refrigerator 40 information related to the user's ice extraction, that is, ice extraction information. The ice extraction information may include information related to a time at which the user has extracted ice and an amount of ice extracted. The server 200 may analyze the user's ice extraction pattern in various ways based on at least one ice extraction information received.

For example, the server 200 may divide a day, that is, 24 hours into a plurality of time intervals according to a preset unit time and detect a section in which the user's ice extraction has been sensed. And a total amount of ice extracted (taken out) in the detected section may be calculated based on an amount of ice extracted at least once within the detected time interval.

In this manner, when the preset plurality of time intervals is used, the server 200 may analyze time intervals, during which the user extracts ice during a day, and amounts of extracted ice. Based on analysis results collected for a predetermined period of time, a time at which the user habitually extracts ice and an amount of ice extracted at that time can be analyzed, thereby generating an ice extraction pattern of the user according to the analysis result.

Alternatively, the server 200 may group at least one ice extraction information received from the refrigerator 40 according to a preset criterion. For example, when the ice extraction information is received, the controller 110 may detect whether or not there is any other ice extraction information received within a preset time. If there is another ice extraction information received from the refrigerator 40 within the preset time, pieces of the ice extraction information received within the preset time may also be generated as one extraction group.

An ice extraction time of an extraction group may be decided from a plurality of ice extraction time information included in the corresponding extraction group, and a total amount of ice extracted within the preset time may be calculated from amounts of extracted ice of the ice extraction information included in the corresponding extraction group. Based on the ice extraction time and a total amount of extracted ice which are collected for a predetermined period of time, a duration during which the user habitually extracts ice, and an amount of ice extracted during the duration may be analyzed, and an ice extraction pattern may be generated according to the analysis result.

Meanwhile, the server 200 may transmit the generated ice extraction pattern to the refrigerator 40 through the communication network 210. In this case, the refrigerator 40 may generate an ice-making pattern according to the ice extraction pattern based on the ice extraction pattern received through the communication network 210.

The ice-making pattern may include a time at which ice-making is to be started (i.e., ice-making start time) and an amount of ice to be made (i.e., an ice-making amount). For example, the ice-making start time may be set to a preset duration, for example, 2 hours before the user usually extracts ice according to the analyzed ice extraction pattern of the user. Further, the ice-making amount may be an amount of ice which is usually extracted by the user at the corresponding time according to the analyzed ice extraction pattern of the user.

On the other hand, when the server 200 does not have a function of analyzing an ice extraction pattern (e.g., when the server 200 is a GPS satellite), the analysis of the ice extraction pattern may be performed by the refrigerator 40 itself, of course. The ice-making pattern may be generated by the refrigerator 40 itself according to the analyzed ice extraction pattern. In this case, the refrigerator 40 only receives the absolute time information from the server 200 and does not need to transmit the ice extraction information for analyzing the ice extraction pattern to the server 200.

Meanwhile, when the ice-making pattern is generated according to the analyzed ice extraction pattern, the controller 110 of the refrigerator 40 may perform ice-making according to the ice-making pattern. That is, the controller 110 may start to make ice at the ice-making start time included in the ice-making pattern and decide a speed of performing the ice-making according to the ice-making amount included in the ice-making pattern.

That is, in case of a time at which the user extracts a greater amount of ice than a preset average amount, the controller 110 may more accelerate an ice-making speed such that a greater amount of ice can be generated. On the other hand, in case of a time at which the user extracts a less amount of ice than the preset average amount, the controller 110 may decelerate the ice-making speed such that a less amount of ice can be generated. Here, when the user does not extract ice at all, the controller 110 may control the ice-making not to be performed.

For this purpose, the controller 110 may control various components related to ice-making. For example, the controller 110 may control an amount of cold air introduced into the ice-making chamber 60 from the freezing chamber 43 by controlling an opening area of the cold air duct 57 using the duct valve 16. Alternatively, the controller 110 may control an amount of cold air, which is forcibly introduced into the ice-making chamber 60 from the freezing chamber 43 by controlling the cooling fan 15*a* provided in the cold air duct 57. That is, the controller 110 may accelerate the ice-making speed by increasing a rotation speed (revolution per minute (RPM)) of the cooling fan 15*a* or increasing the opening area of the cold air duct 57, and decelerate the ice-making speed by decreasing the RPM of the cooling fan 15*a* or reducing the opening area of the cold air duct 57. On the other hand, when the user does not extract ice at all, the controller 110 may completely block the cold air duct 57 or stop the cooling fan 15*a* to prevent ice-making from being performed.

In addition, the controller 110 may adjust an amount of water supplied for producing ice by controlling the water supply valve for supplying water into the ice maker 83 according to an ice-making amount. In this case, when the ice-making is accelerated due to a greater ice-making amount than an average amount, the controller 110 may control the water supply valve so that a greater amount of water can be supplied to the ice maker 83. On the contrary, when the ice-making is decelerated due to a smaller ice-making amount than the average amount, the controller 110 may control the water supply valve so that a smaller amount of water can be supplied to the ice maker 83. On the other hand, when the user does not extract ice at all, the controller 110 may completely block the water supply valve to prevent water from being supplied to the ice maker 83.

Meanwhile, the ice-making pattern may also be generated by the server 200. In this way, when the server 200 generates the ice-making pattern, the server 200 may generate the ice-making pattern, which includes the ice-making start time and the ice-making amount, according to the generated ice extraction pattern. And the server 200 may generate an ice-making control signal based on the generated ice-making pattern and a measurement result of a current time. Here, the ice-making control signal may include information related to the ice-making amount and may be transmitted to the refrigerator 40. The controller 110 of the refrigerator 40 may then accelerate or decelerate an ice-making speed so that the ice-making is performed according to the ice-making amount included in the ice-making control signal.

Meanwhile, the refrigerator 40 itself according to the embodiment of the present invention, as described above, may analyze an ice extraction pattern, generate an ice-making pattern according to the analyzed ice extraction pattern, and make ice according to the generated ice-making pattern. Alternatively, the refrigerator 40 may provide pieces of ice extraction information to the server 200, receive analyzed ice extraction pattern information from the server 200, generate an ice-making pattern according to the received ice extraction pattern information, and make ice according to the ice-making pattern. Alternatively, the refrigerator 40 may provide only ice extraction information to the server 200 and perform ice-making according to an ice-making control signal received from the server 200.

Hereinafter, an embodiment in which the refrigerator 40 itself analyzes ice extraction pattern and generates an ice-making pattern is referred to as a first embodiment of the present invention, and an embodiment in which the refrigerator 40 generates an ice-making pattern according to ice extraction pattern information received from the server 200 is referred to as a second embodiment. And an embodiment in which the refrigerator 40 provides only ice extraction information to the server 200 and controls the ice-making unit 170 according to an ice-making control signal received from the server 200 is referred to as a third embodiment of the present invention. Meanwhile, it is needless to say that the first, second, and third embodiments are distinguished only for convenience of explanation and are not exclusively configured. That is, the refrigerator 40 of the present invention may operate according to all of the first, second, and third embodiments, and may operate according to any one of the embodiments as needed or selectively.

In the following description, the description of performing ice-making according to an ice-making amount included in an ice-making pattern may refer to accelerating or decelerating an ice-making speed according to the ice-making amount. Also, since the ice-making is enabled by cold air introduced from the cold air duct 57, the process of accelerating or decelerating the ice-making speed may be a process in which the controller 110 accelerates or decelerates the RPM of the cooling fan 15*a* by which the cold air is introduced into the cold air duct 57, or a process in which the controller 110 controls the duct valve 16 of the cold air duct 57 to adjust an opening area of the cold air duct 57.

Hereinafter, description will be given of a control method according to each embodiment in the refrigerator 40 according to the first, second, and third embodiments of the present invention with reference to the accompanying drawings. It will be apparent to those skilled in the art that the present invention may be embodied in other specific forms without departing from the spirit or essential characteristics thereof.

Figure 3:
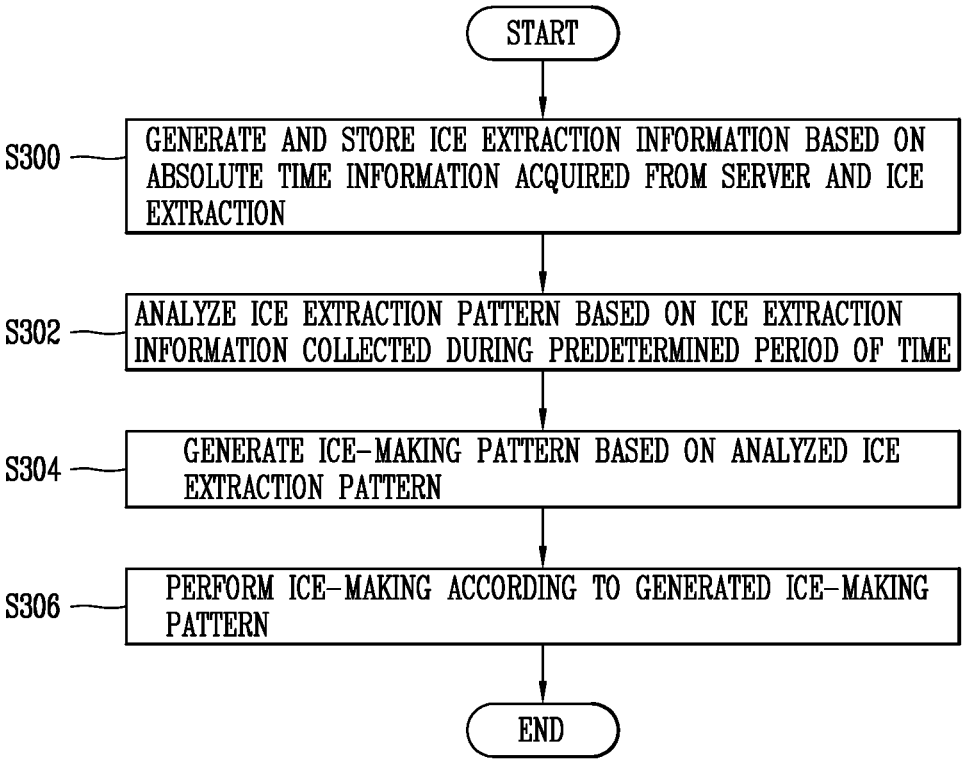
FIG. 3 is a flowchart illustrating a process of performing an ice-making operation according to an analysis result of a user's ice extraction pattern (or ice discharge pattern, ice take-out pattern, etc.), in a refrigerator in accordance with a first embodiment of the present invention.

First, FIG. 3 is a flowchart illustrating a process, in which the refrigerator 40 performs ice-making according to an analysis result of a user's ice extraction pattern, according to the first embodiment of the present invention.

First, the refrigerator 40 according to the embodiment of the present invention may be connected to the server 200 through the communication network 210 as illustrated in FIGS. 2A to 2D. The server 200 may transmit current time information periodically or in response to the refrigerator 40 requesting for absolute time information. The refrigerator 40 may perform time synchronization with the server 200 based on the time information received from the server 200.

The controller 110 of the refrigerator 40 may detect whether the user extracts ice or not in a state that the time synchronization has been done based on the time information, namely, the absolute time information, transmitted from the server 200. When the user's ice extraction is detected, as illustrated in FIG. 3, the controller 110 may generate ice extraction information including information related to an ice extraction time and an amount of extracted ice and then store the generated ice extraction information (S300).

Meanwhile, the controller 110 may collect the ice extraction information for a preset duration. Here, the preset duration may be a duration until the ice extraction information for analyzing an ice extraction pattern is sufficiently collected. The preset duration may be decided to be, for example, 2 weeks, i.e., 14 days. Here, the duration of 14 days may be a duration decided according to a plurality of experiments previously performed in association with the analysis of the ice extraction pattern. Meanwhile, the preset duration may also be decided to be longer or shorter than 14 days by the user or according to arbitrary setting of a manufacturer of the refrigerator 40 or the server 200. Alternatively, the preset duration may be decided according to the number of collected ice extraction information.

Meanwhile, when the ice extraction information is collected for the preset duration, the controller 110 may analyze the ice extraction pattern based on the collected ice extraction information (S302).

Here, the controller 110 may analyze the ice extraction pattern in various manners. For example, the controller 110 may divide 24 hours a day into a plurality of time intervals according to a preset unit time. Then, the controller 110 may detect a time interval in which the user usually takes out ice, based on each time interval and the collected ice extraction information. [Table 1] below shows an example of each divided time interval when the preset unit time is 30 minutes.

TABLE 1

| | 1 | 2 | . . . | 26 | . . . | 47 | 48 |
|---|---|---|---|---|---|---|---|
| START | 24:00:00 | 00:30:00 | . . . | 13:00:00 | . . . | 23:00:00 | 23:30:00 |
| END | 00:29:59 | 00:59:59 | . . . | 13:29:29 | . . . | 23:29:59 | 23:59:59 |

As shown in [Table 1], when the time intervals are divided by a unit time of 30 minutes, the controller 110 may divide 24 hours a day into 48 time intervals. The controller 110 may detect time intervals, in which the user's ice extraction is detected, from each collected extraction information.

On the other hand, when the time intervals in which the user has extracted ice are detected, the controller 110 may decide an extraction time corresponding to each detected time interval. Then, the controller 110 may calculate an average amount of ice extracted by the user in each detected time interval.

For example, the controller 110 may decide a start time ('START') of each detected time interval, in which the ice extraction has been detected, as an extraction time. Then, the controller 110 may sum up an amount of ice extracted by the user per each time interval, in which the ice extraction has been detected, on a day-by-day basis. That is, if the user's ice extraction is detected three times and all the three-time ice extractions are detected in the $26^{th}$ time interval of [Table 1], the controller 110 may sum up each amount of ice extracted three times and store the total amount of ice as an ice extraction amount corresponding to the $26^{th}$ time interval. Also, the ice extraction amount may be stored to correspond to an extraction time which has been decided from the time interval in which the ice extractions have been detected.

Thus, the controller 110 can analyze extraction times at which the user takes out ice every day, and an ice extraction amount corresponding to each of the extraction times. Then, the controller 110 may detect times at which the user habitually takes out ice, based on extraction times analyzed every day for a preset duration and ice extraction amounts corresponding to the respective extraction times. For example, the controller 110 may analyze extraction times corresponding to time intervals, in which the user's ice extraction has been detected by a preset number of times or more, as times at which the user habitually takes out ice.

On the other hand, for each time interval, the controller 110 may calculate an average of the ice extraction amounts, which are summed up for each time interval in which the ice extractions have been detected. Therefore, an amount of ice which is taken out by the user per each time interval can be analyzed. That is, by analyzing the user's ice extraction pattern, the extraction times at which the user habitually takes out ice and the ice extraction amounts corresponding to the respective extraction times can be analyzed.

On the other hand, the controller 110 may analyze the user's ice extraction pattern in a manner different from the aforementioned. For example, when the user's ice extraction is detected, the controller 110 may detect whether or not an additional ice extraction occurs within a preset duration from a time at which the ice extraction has been detected. In addition, when the additional ice extraction is detected, the ice extractions detected within the preset duration may be grouped into one extraction group. In this case, the controller 110 may calculate a total amount of ice extracted in the corresponding extraction group by summing up ice extraction amounts from the detected result of the grouped ice extractions. And the ice extraction duration of the corresponding extraction group may be the 'preset duration' which is decided from the time at which the first ice extraction has been detected.

On the other hand, the controller 110 may detect the extraction groups and the ice extraction durations corresponding to the respective extraction groups every day. And the controller 110 may analyze extraction times at which the user habitually takes out ice and ice extraction amounts corresponding to the respective extraction times, based on the extraction groups and the ice extraction durations which have been detected every day for a preset period of time. For example, the controller 110 may detect whether or not there is a duration commonly included in each of the ice extraction durations by a preset number of times or more. [Table 2]

below shows an example of detecting whether or not there is such commonly included duration.

TABLE 2

| | 1 | 2 | . . . | 26 | . . . | 47 | 48 |
|---|---|---|---|---|---|---|---|
| START | 24:00:00 | 00:30:00 | . . . | 13:00:00 | . . . | 23:00:00 | 23:30:00 |
| END | 00:29:59 | 00:59:59 | . . . | 13:29:29 | . . . | 23:29:59 | 23:59:59 |

[Table 2] shows an example of each extraction group detected by the controller 110 for one to three days, and ice extraction time durations decided from initial ice extraction times of the respective extraction groups. For example, in case where a preset time duration is 30 minutes, when the user takes out ice at 12:45 on the first day, an ice extraction time duration is set and detected as a time duration from 12:45 to 13:15 (a first extraction group). When another ice extraction occurs within the time duration from 12:45 to 13:15, the another ice extraction may be included in the same extraction group. When the user takes out ice at 12:55 on the second day, an ice extraction time duration may be set and detected as a duration from 12:55 to 13:25 (a second extraction group). When the user takes out ice at 13:00 on the third day, an ice extraction time duration may be set and detected as a duration from 13:00 to 13:30 (a third extraction group).

On the other hand, when the ice extraction durations are detected as described above, the controller 110 may extract a duration, which is commonly included, from each of the ice extraction durations. That is, when the extracted ice extraction durations are as shown in [Table 2], the controller 110 may extract a time interval from 13:00 to 13:15, which is included commonly, from the ice extraction durations detected for the first to third days.

On the other hand, the controller 110 may decide an extraction time from the extracted time interval. For example, the controller 110 may decide a start time (e.g., 13:00) of the extracted time interval as the extraction time. Alternatively, the controller 110 may decide a middle time of the extracted time interval, i.e., a middle of the time interval from 13:00 to 13:15, in other words, 13:07:30, as the extraction time.

On the other hand, the controller 110 may decide an ice extraction amount corresponding to the decided extraction time. For example, the controller 110 may decide the ice extraction amount from ice extraction amounts of extraction groups which include the decided extraction time of the set ice extraction duration. That is, when the extraction time is decided to be 13:07:30 as described above, all of the first to third extraction groups in the above [Table 2] may be extraction groups including the extraction time. In this case, the controller 110 may decide an ice extraction amount corresponding to the decided extraction time as an average amount of the ice extraction amounts extracted in the first to third extraction groups. Accordingly, the controller 110 can analyze the extraction times at which the user habitually takes out ice and the ice extraction amounts corresponding to the respective extraction times, that is, can analyze the user's ice extraction pattern.

When the user's ice extraction pattern is analyzed in step S302, the controller 110 may generate an ice-making pattern based on the analyzed ice extraction pattern (S304). Here, the ice-making pattern may refer to an ice-making schedule which includes an ice extraction amount corresponding to each extraction time as an ice-making amount, in a state that a time before a predetermined time duration (e.g., 2 hours) from each extraction time according to the analyzed user ice extraction pattern is an ice-making start time. For example, when the predetermined duration is 2 hours and the extraction times analyzed according to the user's ice extraction pattern are 13:00, 18:00, and 20:00, the controller 110 may set an ice-making time such that ice-making is started at 11:00, 16:00, and 18:00, respectively.

And an ice-making speed may be accelerated or decelerated according to an ice-making amount corresponding to each ice-making time. For example, the controller 110 may accelerate the ice-making speed when the ice-making amount is larger than an average value of a preset ice-making amount. On the other hand, the ice-making speed may be decelerated when the ice-making amount is smaller than the average value of the preset ice-making amount. Here, the acceleration of the ice-making speed may be achieved as the controller 110 increases the RPM of the cooling fan 15*a* or increases the opening area of the cold air duct 57. On the other hand, the deceleration of the ice-making speed may be achieved as the controller 110 decreases the RPM of the cooling fan 15*a* or decreases the opening area of the cold air duct 57. Meanwhile, the controller 110 may control the water supply valve to adjust an amount of water supplied to the ice maker 83 according to the set ice-making amount.

Here, the controller 110 may calculate a total amount of ice extracted for the preset time duration, namely, two weeks based on a total open time of the extraction opening for the preset time duration of two weeks, thereby calculating the user's daily average ice consumption amount. The controller 110 may decide the number of times that the user extracts ice one day according to the daily average ice consumption amount and the analyzed ice extraction pattern, and an average value of the ice-making amount according to the open time of the extraction opening every time that ice is extracted.

Of course, the controller 110 may decide the ice-making start time differently according to the ice extraction amounts corresponding to the respective ice extraction times, respectively. In addition, the controller 110 may generate more ice than a predetermined level in preparation of a case where the user extracts more ice than usual. In this case, the controller 110 may also decide the ice-making amount corresponding to each ice-making time so that a preset rate (for example, 10%) of ice is further generated for the ice-extraction amount corresponding to each extraction time.

Meanwhile, when the ice-making pattern is generated, the controller 110 may perform ice-making according to the generated ice-making pattern (S306). In other words, the controller 110 may check a current time and an ice-making time according to the ice-making pattern and accelerate or decelerate the ice-making according to an ice-making amount corresponding to the ice-making time. When the user selects ice discharge, ice generated according to the ice-making pattern may be discharged. Therefore, the refrigerator 40 according to the embodiment of the present invention allows ice to be discharged as much as the user needs when the user selects the ice discharge.

On the other hand, when the ice extraction pattern is analyzed in step S302, the controller 110 may determine whether or not a prestored ice-making pattern is present, and newly generate or update the ice-making pattern according to the determination result.

Figure 4:
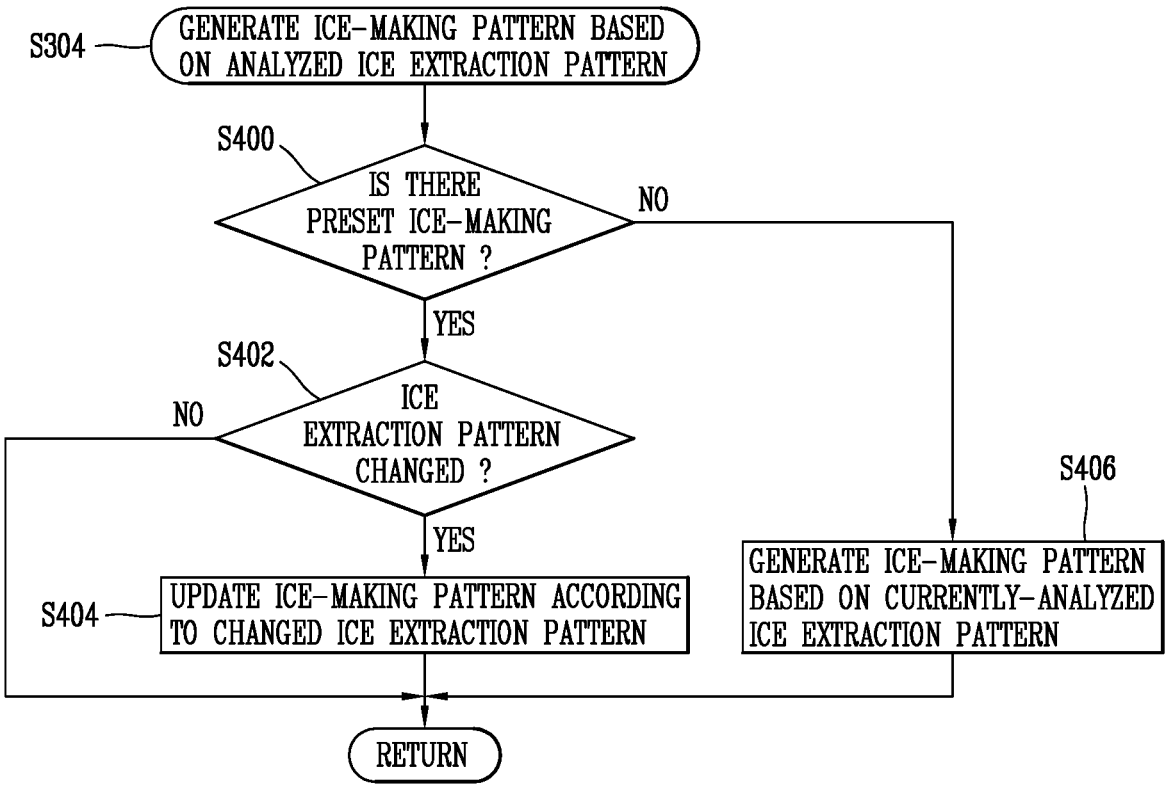
FIG. 4 is a flowchart illustrating a process of updating an ice-making pattern based on an analysis result of the user's ice extraction pattern in FIG. 3.

FIG. 4 is a flowchart illustrating a process of updating the ice-making pattern based on an analysis result of the user's ice extraction pattern in step S304 of FIG. 3, in the above case.

Referring to FIG. 4, when the ice-making pattern is analyzed in step S302, the controller 110 may check whether there is a preset ice-making pattern (S400). When there is not a preset ice-making pattern according to the check result of step S400, the controller 110 may generate an ice-making pattern including an ice-making time and an ice-making amount based on a currently-analyzed ice extraction pattern (S406).

On the other hand, when there is a preset ice-making pattern according to the check result of step S400, the controller 110 may detect whether any change has occurred by comparing an ice extraction pattern corresponding to the preset ice-making pattern, namely, a previously-analyzed ice extraction pattern with the ice extraction pattern analyzed in step S302 (S402). For example, the controller 110 may determine that the ice extraction pattern has changed when at least one extraction time or extraction amount has changed as a result of the analysis of the ice extraction pattern.

On the other hand, when any change has not occurred according to the result of the check of the change in the ice extraction pattern, the controller 110 may not update the ice extraction pattern. In this case, the controller 110 may maintain the currently-set ice-making pattern. The controller 110 may control the ice-making unit 170 in step S306 of FIG. 3 so that ice-making according to a preset ice-making pattern is performed.

On the other hand, when the change has occurred according to the result of the check of the change in the ice extraction pattern, the controller 110 may update the ice extraction pattern (S404). In this case, the controller 110 may change the ice-making pattern according to the changed ice extraction time or extraction amount. Then, the controller 110 may control the ice-making unit 170 in step S306 of FIG. 3 so that ice-making is performed according to the changed ice-making pattern.

Meanwhile, the ice-making pattern updating process of FIG. 4 may be performed every time the ice extraction pattern is analyzed. That is, the ice-making pattern updating process of FIG. 4 may be performed every preset period of time until ice extraction information sufficient for analyzing the ice extraction pattern is collected, or every preset period of time set by the user or a manufacturer which has manufactured the refrigerator 40 or the server 200. For example, the preset period of time may be two weeks, i.e., 14 days.

Meanwhile, FIGS. 3 and 4 have illustrated the case where the refrigerator 40 performs both of the analysis of the user's ice extraction pattern and the ice-making pattern generation. On the other hand, when the user takes out ice, the refrigerator 40 may transmit information related to an extracted time and an extracted amount of the ice, namely, ice extraction information to the server 200, and the server 200 may analyze the user's ice extraction pattern based on the ice extraction information received from the refrigerator 40.

Figure 5:
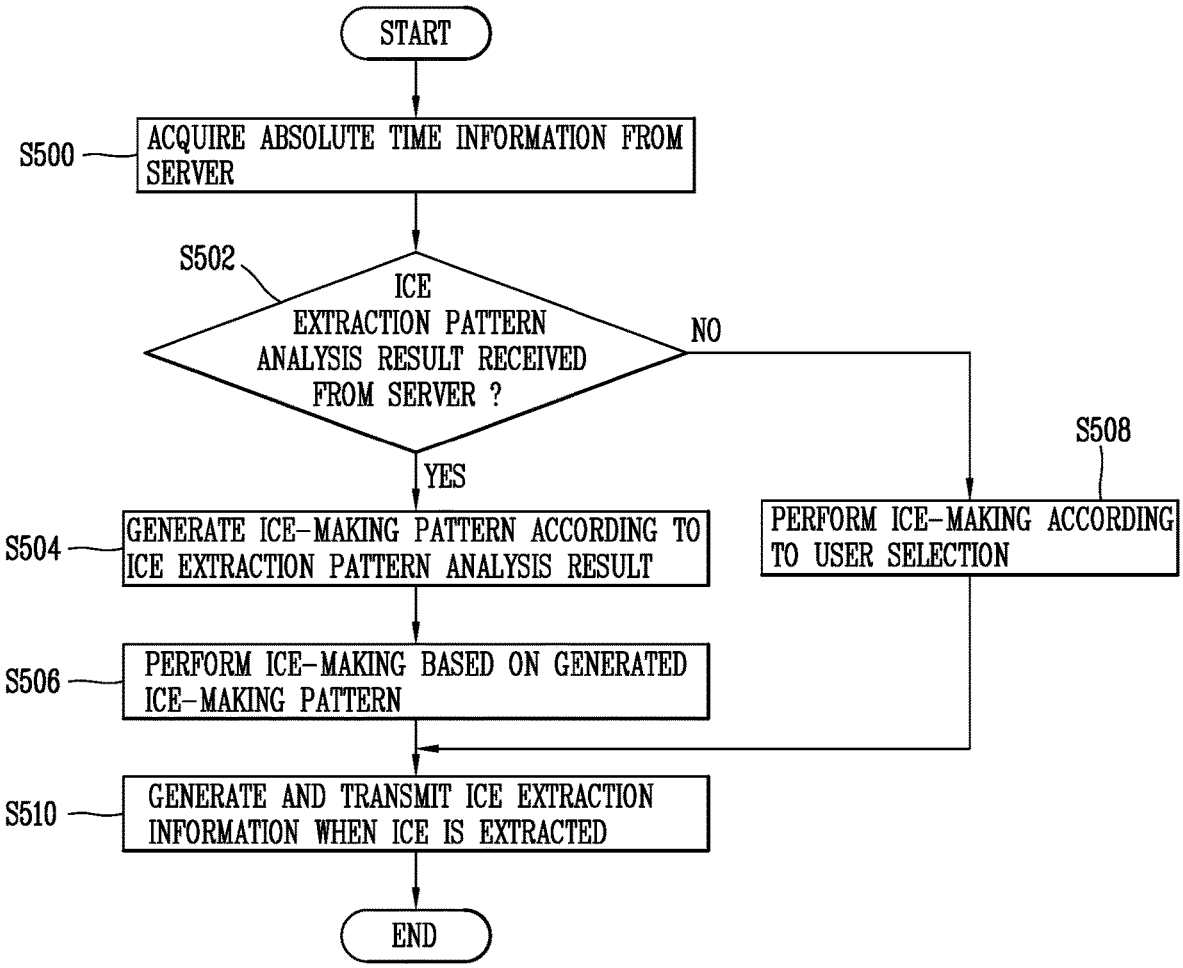
FIG. 5 is a flowchart illustrating a process of performing an ice-making operation according to an analysis result of an ice extraction pattern received from a server, in a refrigerator in accordance with a second embodiment of the present invention.

FIG. 5 is a flowchart illustrating a process in which the refrigerator 40 performs ice-making according to the analysis result of the ice extraction pattern received from the server 200 according to the second embodiment of the present invention.

Referring to FIG. 5, the controller 110 of the refrigerator 40 according to the embodiment of the present invention may first acquire absolute time information from the server 200 (S500). Then, the controller 110 may perform time synchronization with the server 200 based on the acquired absolute time information.

Meanwhile, the controller 110 may receive an analysis result of an ice extraction pattern from the server 200 (S502). Here, the analysis result of the ice extraction pattern may include information related to extraction times at which the user normally takes out ice, and ice extraction amounts corresponding to the respective extraction times.

On the other hand, when the analysis result of the ice extraction pattern is not received from the server 200 in step S502, the controller 110 may control the ice-making unit 170 to perform ice-making according to the user's selection (S508). For example, the controller 110 may control the ice-making unit 170 to generate ice in response to a key input applied by the user.

On the other hand, when the analysis result of the ice extraction pattern is received from the server 200 in step S502, the controller 110 may generate an ice-making pattern based on the received ice extraction pattern (S504). For example, the controller 110 may set ice-making times in a manner that the ice-making is started before a predetermined time duration from each of the extraction times included in the analysis result of the ice extraction pattern. And the controller 110 may set an ice-making amount corresponding to each ice-making time according to ice extraction amounts of the respective ice extraction times. The controller 110 may accelerate or decelerate an ice-making speed so that the ice-making can be performed based on the generated ice-making pattern.

In this case, the controller 110 may set the ice-making time to a time earlier than a time before the predetermined time duration from the extraction time in the case of an ice-making time at which the ice-making amount is greater than a preset level. In addition, the controller 110 may set the ice-making amount so that a greater amount of ice than each ice extraction amount by a preset ratio is generated. This is to prepare for a case where the user unexpectedly takes out a great amount of ice.

Meanwhile, when the ice-making is performed according to the ice-making pattern generated in step S506 or when the ice-making is performed according to the user's selection in step S508, the controller 110 may detect whether or not the user has extracted ice. When the user has extracted ice, the controller 110 may generate ice extraction information including an extracted time of the ice and an extracted amount of the ice and transmit the generated ice extraction information to the server 200 (S510).

The server 200 may analyze the user's ice extraction pattern based on the ice extraction information received from the refrigerator 40. For example, the server 200, similar to that illustrated in FIG. 3, may divide 24 hours a day into a plurality of time intervals according to a preset unit time, and detect a time interval, at which the user usually extracts ice, based on each time interval and the ice extraction information received from the refrigerator 40. Then, the server 200 may calculate an amount of ice extracted in the corresponding time interval. The server 200 may decide at least one extraction time and at least one ice extraction amount corresponding to the decided extraction time, based on time intervals detected for a predetermined period of time and amounts of ice extracted in the corresponding tine time intervals. Then, the server 200 may transmit the decided at least one extraction time and ice extraction amount to the refrigerator 40 as the analysis result of the user's ice extraction pattern.

Alternatively, the server 200 may decide, as the ice extraction duration, a preset time duration from the ice extraction time included in the received ice extraction information. When a plurality of ice extraction durations is decided from a plurality of ice extraction information received from the refrigerator 40, the server 200 may detect time intervals commonly included in the plurality of ice extraction durations. Then, the server 200 may decide at least one extraction time based on the detected common time intervals and decide at least one ice extraction amount corresponding to the decided at least one extraction time. The server 200 may then transmit the decided at least one extraction time and ice extraction amount to the refrigerator 40 as the analysis result of the user's ice extraction pattern.

Meanwhile, unlike the second embodiment, when the server analyzes the user's ice extraction pattern, the server 200 may also generate the ice-making pattern. In this case, at the ice-making time according to the ice-making pattern, the server 200 may transmit an ice-making control signal including the ice-making amount to the refrigerator 40, and the refrigerator 40 may perform ice-making based on the ice-making control signal.

Figure 6:
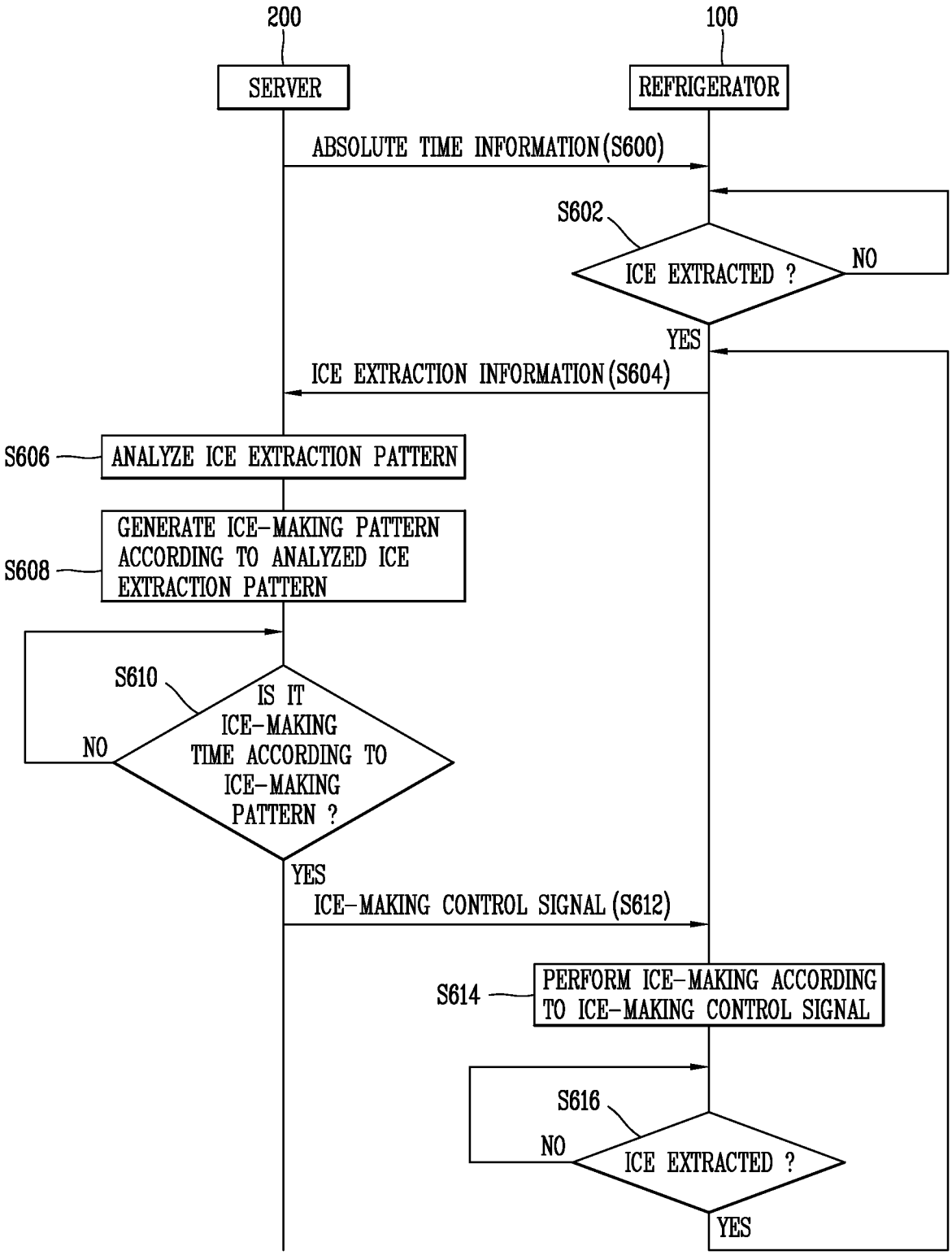
FIG. 6 is a flowchart illustrating a process of performing an ice-making operation according to an ice-making control signal received from a server, in a refrigerator in accordance with a third embodiment of the present invention.

FIG. 6 is a flowchart illustrating a process in which the refrigerator 40 according to the third embodiment of the present invention performs ice-making according to the ice-making control signal received from the server 200.

Referring to FIG. 6, the server 200 may first transmit absolute time information to the refrigerator 40 (S600). Then, the refrigerator 40 may achieve time synchronization with the server 200 based on the received absolute time information.

In this state, the refrigerator 40 may detect the user's ice extraction (S602). When the ice extraction is detected, the refrigerator 40 may transmit ice extraction information, which includes information related to a time at which the ice has been extracted and an amount of the extracted ice, to the server 200 (S604).

On the other hand, when the ice extraction information is received from the refrigerator 40 in step S604, the server 200 may analyze the user's ice extraction pattern based on the received ice extraction information (S606). For example, the server 200 may analyze the ice extraction pattern during a preset period of time or when ice extraction information sufficient for analyzing the user's ice extraction pattern is collected.

For example, similarly to the second embodiment of the present invention, the server 200 may divide 24 hours a day into a plurality of time intervals according to a preset unit time and detect a time interval, in which the user usually extracts ice, based on each time interval and ice extraction information received from the refrigerator 40. The server may then analyze the user's ice extraction time according to at least one extraction time and ice extraction amount decided based on time intervals detected for a predetermined period of time and amounts of ice extracted in the corresponding time intervals.

Alternatively, the server 200 may decide an ice extraction time duration from the ice extraction time of the received ice extraction information. When a plurality of ice extraction time durations is decided, the server 200 may detect time intervals included in common. The server 200 may then decide at least one extraction time and at least one ice extraction amount decided based on the detected commonly included time interval. Then, the server 200 may analyze the user's ice extraction pattern based on the decided at least one extraction time and ice extraction amount.

When the server 200 analyzes the user's ice extraction pattern in step S606, the server 200 may generate an ice-making pattern according to the analyzed ice extraction pattern (S608). For example, the server 200 may set ice-making times in a manner that the ice-making is started before a predetermined time duration from each extraction time according to the analysis result of the ice extraction pattern. The server 200 may then set ice-making amounts corresponding to the respective ice-making times according to the ice extraction amount corresponding to each extraction time. The set ice-making times and the ice-making amounts may be included in the ice-making pattern.

Here, the ice-making time may also be set to a time earlier than a time before a predetermined time duration from the extraction time, based on the ice extraction amount of the corresponding extraction time. Further, the ice-making amount may also be set to a greater amount by a preset ratio than the ice extraction amount of the corresponding extraction time.

When the ice-making pattern is generated, the server 200 may measure a current time and check whether the current time is a time corresponding to one of the ice-making times according to the ice-making pattern (S610). When the current time is the time corresponding to the one of the ice-making times according to the ice-making pattern according to the check result of step S610, the server 200 may transmit an ice-making control signal, which includes ice-making amount information according to the ice-making time corresponding to the current time, to the refrigerator 40 (S612). Then, the refrigerator 40 may perform the ice-making according to the received ice-making control signal (S614). In this case, the refrigerator 40 may accelerate or decelerate an ice-making speed so that ice is generated according to the ice-making amount included in the ice-making control signal.

Meanwhile, when the ice-making is performed according to the ice-making control signal, the refrigerator 40 may detect whether or not the user has extracted ice again (S616). When it is detected in step S616 that the ice extraction has occurred again, the refrigerator 40 may go back to the step S604 to transmit the ice extraction information, which includes the time at which the ice extraction has occurred and the amount of extracted ice, to the server 200.

On the other hand, according to the foregoing description, the refrigerator 40 may generate ice according to the ice-making amount based on the ice-making pattern at the ice-making time based on the ice-making pattern. And it has been mentioned that the user can discharge the previously-generated ice when the user extracts ice. In this manner, in case where ice is made in advance, if previously-generated ice is not discharged completely, the ice produced in the ice-making unit 170 may be left. If the previously-generated ice is left, the controller 110 may also perform the ice-making according to a result of comparing an amount of currently-stored ice with an ice-making amount set according to an ice-making pattern or an ice-making control signal.

That is, in the state where the previously-generated ice remains, when the ice-making is performed according to the ice-making pattern or the ice-making control signal received from the server 200, the controller 110 may compare the ice-making amount according to the ice-making pattern or the received ice-making control signal with the amount of currently-remaining ice. When the amount of currently-remaining ice is greater than the ice-making amount, the controller 110 may not perform the ice-making. Here, the amount of remaining ice may be detected through at least one sensor provided in the sensing unit 130.

On the other hand, when the amount of remaining ice is smaller than the ice-making amount, the controller 110 may change the ice-making amount based on a difference between the ice-making amount and the remaining ice amount. That is, the controller 110 may control the ice-making unit 170 so that ice is generated only as much as an insufficient amount based on the ice-making amount.

As described above, according to the present invention, an ice-making pattern can be generated according to an analysis result of a user's ice extraction pattern, and an ice-making speed of the ice-making unit 170 can be controlled according to the generated ice-making pattern. Accordingly, when the user needs more ice than an average value, the ice-making speed can increase, so that ice can be supplied in an amount required by the user. On the other hand, when the user extracts a smaller amount of ice than the average value, an amount of cold air flowing out of a freezing chamber can be reduced according to a decrease of the ice-making speed, thereby minimizing a temperature rise of the freezing chamber due to the reduced cold air. That is, the present invention can prevent cold air from flowing out of the freeing chamber for unnecessary ice-making, so that power cannot be wasted.

Effects of a refrigerator and a refrigerator system according to the present invention will be described as follows.

According to at least one of embodiments of the present invention, ice-making can be performed according to a user's ice extraction pattern before a time, at which the user extracts ice, based on the user's ice extraction pattern, so that an amount of ice required by the user can be discharged when the user selects an ice discharge.

According to at least one of embodiments of the present invention, ice-making can be performed according to a user's ice extraction pattern, so as to save energy consumed for making ice which the user does not need when the user does not need a lot of ice.

The present invention described above can be implemented as computer-readable codes on a program-recorded medium. The computer readable medium includes all kinds of recording devices in which data readable by a computer system is stored. Examples of the computer-readable medium include a hard disk drive (HDD), a solid state disk (SSD), a silicon disk drive (SDD), a ROM, a RAM, a CD-ROM, a magnetic tape, a floppy disk, an optical data storage device and the like, and may also be implemented in the form of a carrier wave (e.g., transmission over the Internet). In addition, the computer may also include the controller 180 of the terminal. The above detailed description should not be limitedly construed in all aspects and should be considered as illustrative. The scope of the present invention should be determined by rational interpretation of the appended claims, and all changes within the scope of equivalents of the present invention are included in the scope of the present invention.

What is claimed is:

1. A refrigerator, comprising:

an evaporator configured to generate cold air;

a freezing chamber configured to be cooled based on cold air generated by the evaporator;

an ice-making unit configured to generate ice based on cold air generated by the evaporator;

a cold air duct that connects the freezing chamber to the ice-making unit and that is configured to guide cold air from the freezing chamber to the ice-making unit;

a discharge unit configured to discharge ice generated by the ice-making unit; and a controller configured to:

generate ice extraction information that includes an extraction time at which a user has extracted ice, and an amount of ice extracted at the extraction time, determine an ice extraction pattern of the user based on a plurality of ice extractions captured in the ice extraction information, based on the ice extraction pattern, generate an ice-making pattern that includes one or more ice-making start times in which the ice-making unit initiates generation of ice and an ice-making amount corresponding to each ice-making start time, and based on the ice-making amount corresponding to each ice-making start time, adjust an amount of cold air introduced from the freezing chamber to the ice-making unit through the cold air duct to accelerate or decelerate an ice-making speed corresponding to each ice-making start time, wherein the controller is further configured to: based on a current time corresponding to one or more ice-making start times compare the ice-making amount corresponding to the one of the one or more ice-making start times to a remaining amount of ice in the ice-making unit, update the ice-making amount based on a difference between the ice-making amount and the remaining amount of ice in the ice-making unit, and adjust the amount of cold air introduced into the ice-making unit through the cold air duct according to the updated ice-making amount.

2. The refrigerator of claim 1, wherein the cold air duct includes a duct valve configured to adjust an opening area of the cold air duct, and wherein the controller is further configured to control the opening area of the duct valve to adjust the amount of cold air introduced from the freezing chamber to the ice-making unit based on the ice-making amount corresponding to each ice-making start time.

3. The refrigerator of claim 1, wherein the cold air duct includes a cooling fan configured to blow cold air from the freezing chamber to the cold air duct, and wherein the controller is further configured to control a rotation speed of the cooling fan to adjust the amount of cold air introduced from the freezing chamber to the ice-making unit based on the ice-making amount corresponding to each ice-making start time.

4. The refrigerator of claim 1, wherein the ice-making unit includes a water supply valve configured to control supply of water to the ice-making unit, and wherein the controller is further configured to control the water supply valve to adjust an amount of water supplied to the ice-making unit based on the ice-making amount corresponding to each ice-making start time.

5. The refrigerator of claim 1, wherein the discharge unit includes an extraction outlet configured to discharge ice to an outside, and wherein the controller is further configured to:

determine whether the extraction outlet is opened or closed, based on a determination that the extraction outlet is opened at an open time, determine that the user extracted ice at the open time, based on a determination that the extraction outlet is closed, determine a lack of extraction of ice, determine to include, in the ice extraction information, information related to the open time at which the extraction outlet is opened, and determine the amount of ice extracted by the user based on a duration of the extraction outlet remaining open.

6. The refrigerator of claim 1, wherein the controller is further configured to:

based on the ice extraction pattern, determine one or more predicted extraction times at which the user is predicted to extract ice;

determine an ice extraction amount corresponding to each predicted ice extraction time;

determine the one or more ice-making start times based on time instants that are respectively before the one or more predicted extraction times by a preset time duration; and based on the ice extraction amount corresponding to each predicted ice extraction time, determine the ice-making amount corresponding to each ice-making start time.

7. The refrigerator of claim 6, wherein the controller is further configured to:

define a plurality of time intervals of a day;

based on the plurality of time intervals and the ice extraction information of a plurality of days, determine a number of extractions during each time interval of the plurality of days;

identify at least one time interval that includes the number of extractions that is greater than or equal to a preset number;

determine at least one ice extraction time based on the at least one time interval;

determine a total amount of ice for each time interval based on summation of an amount of ice extracted during each time interval;

based on the total amount of ice for each time interval, determine an average amount of ice for each time interval; and based on the average amount of ice, determine an ice extraction amount corresponding to each ice extraction time.

8. The refrigerator of claim 7, wherein the controller is further configured to:

detect a sample amount of ice extracted from the discharge unit; and based on a determination that the sample amount of ice is greater than the average amount of ice, increase the amount of cold air introduced from the freezing chamber to the ice-making unit through the cold air duct to accelerate the ice-making speed.

9. The refrigerator of claim 8, wherein the controller is further configured to, based on a determination that the sample amount of ice is less than the average amount of ice, decrease the amount of cold air introduced from the freezing chamber to the ice-making unit through the cold air duct to decelerate the ice-making speed.

10. The refrigerator of claim 7, wherein the at least one ice extraction time corresponds to a median time of the at least one time interval.

11. The refrigerator of claim 6, wherein the controller is further configured to:

based on the plurality of ice extractions captured in the ice extraction information, determine ice extraction time durations during which ice has been extracted;

determine at least one common time interval that overlaps two or more ice extraction time durations;

determine at least one ice extraction time based on the at least one common time interval;

determine a total amount of ice for each ice extraction time duration based on summation of an amount of ice extracted during each ice extraction time duration;

based on the total amount of ice, determine an average amount of ice for the two or more ice extraction time durations that include the at least one common time interval; and based on the average amount of ice, determine an ice extraction amount corresponding to each ice extraction time.

12. The refrigerator of claim 11, wherein the controller is further configured to:

detect a sample amount of ice extracted from the discharge unit; and based on a determination that the sample amount of ice is greater than the average amount of ice, increase the amount of cold air introduced from the freezing chamber to the ice-making unit through the cold air duct to accelerate the ice-making speed.

13. The refrigerator of claim 12, wherein the controller is further configured to, based on a determination that the sample amount of ice is less than the average amount of ice, decrease the amount of cold air introduced from the freezing chamber to the ice-making unit through the cold air duct to decelerate the ice-making speed.

14. The refrigerator of claim 1, further comprising a communication unit configured to communicate with a server, wherein the controller is further configured to:

receive time information from the server through the communication unit, and synchronize a time of the refrigerator with a time of the server based on the time information received from the server.

15. The refrigerator of claim 14, wherein the controller is further configured to:

control the communication unit to transmit the ice extraction information to the server;

receive, from the server through the communication unit, an analysis result of the ice extraction information transmitted to the server, the analysis result from the server including information corresponding to the ice extraction pattern; and based on the analysis result received from the server, generate an ice-making pattern that includes one or more ice-making start times and an ice-making amount corresponding to each ice-making start time.

16. The refrigerator of claim 14, wherein the controller is further configured to:

control the communication unit to transmit the ice extraction information to the server;

receive, from the server through the communication unit, an ice-making start time that is included in an ice-making pattern generated by the server based on the ice extraction information transmitted to the server;

based on the current time corresponding to the received ice-making start time, receive, from the server, an ice-making control signal that includes information related to an ice-making amount corresponding to the received ice-making start time; and based on a reception of the ice-making control signal from the server, adjust the amount of cold air introduced to the ice-making unit from the freezing chamber through the cold air duct to accelerate or decelerate the ice-making speed according to the ice-making amount corresponding to the received ice-making start time.

17. A method for controlling a refrigerator including a freezing chamber, an ice-making unit, and a cold air duct that connects the freezing chamber to the ice-making unit, the method comprising:

determining a plurality of extraction times at which a user has extracted ice and an amount of ice extracted at each extraction time;

generating ice extraction information that includes the plurality of extraction times and the amount of ice extracted at each extraction time;

determining an ice extraction pattern of the user based on the ice extraction information;

based on the ice extraction pattern, determining an ice-making pattern that includes one or more ice-making start times for initiating generation of ice and an ice-making amount corresponding to each ice-making start time; and based on the ice-making amount corresponding to each ice-making start time, adjusting an amount of cold air introduced from the freezing chamber to the ice-making unit through the cold air duct to accelerate or decelerate an ice-making speed corresponding to each ice-making start time, wherein adjusting the amount of cold air comprises: based on a current time corresponding to one or more ice-making start times, comparing the ice-making amount corresponding to the one or the one or more ice-making start times to a remaining amount of ice in the icemaking unit, updating the ice-making amount based on a difference between the ice-making amount and the amount of cold air introduced into the ice-making unit through the cold air duct according to the updated ice-making amount.

18. The method of claim 17, wherein determining the plurality of extraction times comprises detecting events in which an extraction outlet of the ice-making unit is opened, and wherein determining the amount of ice extracted at each extraction time comprises detecting a duration of each event.

19. The method of claim 17, wherein generating the ice extraction information comprises:

defining a plurality of time intervals of a day;

determining a number of extractions during each time interval for a plurality of days;

identifying at least one time interval that includes the number of extractions that is greater than or equal to a preset number;

determining at least one ice extraction time based on the at least one time interval;

determining a total amount of ice for each time interval based on summation of an amount of ice extracted during each time interval for the plurality of days;

based on the total amount of ice corresponding to each time interval, determining an average amount of ice for each time interval; and based on the average amount of ice, determining an ice extraction amount corresponding to each ice extraction time.

20. The method of claim 17, further comprising:

based on the ice extraction pattern, determining one or more predicted extraction times at which the user is predicted to extract ice;

determining an ice extraction amount corresponding to each predicted ice extraction time;

determining the one or more ice-making start times based on time instants that are respectively before the one or more predicted ice extraction times by a preset time duration; and base on the ice extraction amount corresponding to each predicted ice extraction time, determining the ice-making amount corresponding to each ice-making start time.

* * * * *